United States Patent [19]

Easterling

[11] 4,084,643

[45] Apr. 18, 1978

[54] MOTOR GRADER WITH BLADE SUPPORT STRUCTURE

[75] Inventor: Gene Baptist Easterling, Decatur, Ill.

[73] Assignee: Caterpillar Tractor Co., Peoria, Ill.

[21] Appl. No.: 745,507

[22] Filed: Nov. 26, 1976

[51] Int. Cl.[2] ..... E02F 3/76

[52] U.S. Cl. ..... 172/795; 172/743

[58] Field of Search ..... 172/305, 476, 667, 673, 172/741, 743, 781, 783, 789, 791, 792, 793, 795, 796, 797; 403/110

[56] References Cited

U.S. PATENT DOCUMENTS

| | | | |
|---|---|---|---|
| 2,024,994 | 12/1935 | Cost | 172/793 |
| 2,799,099 | 7/1957 | Leliter | 172/667 |
| 3,191,324 | 6/1965 | Beyers et al. | 172/783 X |
| 3,463,243 | 8/1969 | Fisher | 172/743 |
| 3,465,829 | 9/1969 | Fisher et al. | 172/743 |

*Primary Examiner*—Richard T. Stouffer

*Attorney, Agent, or Firm*—Wegner, Stellman, McCord, Wiles & Wood

[57] ABSTRACT

A motor grader has improved support structure for mounting the grader blade on the circle blade support arms and for controlling blade tilt. A bearing housing structure consists of a transverse structural member with integral upright bearing housings at its two ends, is slightly shorter than the space between the support arms, and is carried on pivots at the lower ends of the arms with facing bearings so the bearing housing structure reinforces the arms against lateral deflection. The grader blade support rails extend through upper and lower jaws in the bearing housings with the weight of the blade carried in bearing plates in the upper jaws and the lower rail guided between parallel upright bearing plates in the lower jaw which is otherwise free of contact with the lower jaw. Blade tilt is controlled by a single hydraulic cylinder pivotally mounted on the circle midway between the arms with its piston rod pivotally connected to the transverse structural member.

25 Claims, 5 Drawing Figures

MOTOR GRADER WITH BLADE SUPPORT STRUCTURE

BACKGROUND OF THE INVENTION

The conditions in which motor graders are used requires that the entire suspension for the grader blade be extremely rugged and able to withstand severe stresses encountered in use. It is desirable that the rugged construction and stress resistance be achieved, however, by sound structural engineering, rather than by sheer massiveness of components, both to reduce material costs and to reduce power requirements in operation of the grader.

In addition to the need for increasing strength and ruggedness of equipment without substantial weight increase, or even with some weight reduction, manufacturing costs can be controlled by reducing the number of components required to achieve the same result; and also by avoiding constructions which require building to close tolerances.

Another important factor in any type of industrial equipment, and particularly in very heavy equipment which must often be field serviced, is the ease of servicing which includes, of course, the removal and replacement of worn parts.

Patents which disclose typical prior art structures for supporting a grader blade on a motor grader circle include Leliter U.S. Pat. No. 2,799,099; Beyers et al U.S. Pat. No. 3,191,324; Fisher U.S. Pat. No. 3,463,243; and Fisher et al U.S. Pat. No. 3,465,829.

SUMMARY OF THE INVENTION

The principal object of the present invention is to provide improved support means for mounting the grader blade on the circle blade support arms of a motor grader, and for controlling blade tilt.

Another object of the invention is to provide a bearing housing structure which supports a grader blade in the circle support arms and which fills the entire space between the support arms so as to reinforce them against lateral deflection.

Still another object of the invention is to provide a support for a motor grader blade in which the weight of the blade is carried upon an upper rail which is slidable in a complementary channel in a pair of upper jaws of the bearing housing, with the lower rail of the blade confined between parallel, upright bearing plates in an upwardly open lower jaw, with the lower rail being otherwise entirely out of contact with the bearing housings. This accommodates any reasonable lack of parallelism between the upper and lower rails while affording full surface contact between the rails and the bearing members in which they are supported.

Yet another object of the invention is to provide bearing housing structures in which replaceable bearing inserts which define a rectangular passage in which the upper grader blade rail slides are mounted in the upper end of a housing body member and in the underside of a removable upper bearing cap, so that replacement of the bearing inserts may be relatively easily accomplished in the field.

Still another object of the invention is to provide a bearing housing structure in which the lower bearing plates are mounted between a forwardly facing planar surface at the lower end of the bearing housing, a removable lower bearing cap, and spacer means, so that the lower bearing plates may be readily removed and replaced in the field.

Still another object of the invention is to provide a bearing housing structure in which cavities to receive upper bearing inserts are segments of cylinders in which the bearing inserts are rotatable about axes parallel to the longitudinal axis of the grader blade upper rail, so that the bearing surfaces of the bearing inserts may be in full surface contact with the surfaces of the upper rail despite minor variations in the orientation of the upper rail with respect to the back of the grader blade.

Still another object of the invention is to provide a structure in which the tilt control for the grader blade constitutes a single hydraulic cylinder and piston unit which is pivotally mounted on the circle midway between the blade support arms and which has its piston rod pivotally connected to the transverse structural member of the bearing housing structure.

THE DRAWINGS

DETAILED DESCRIPTION OF THE INVENTION

Figure 1:
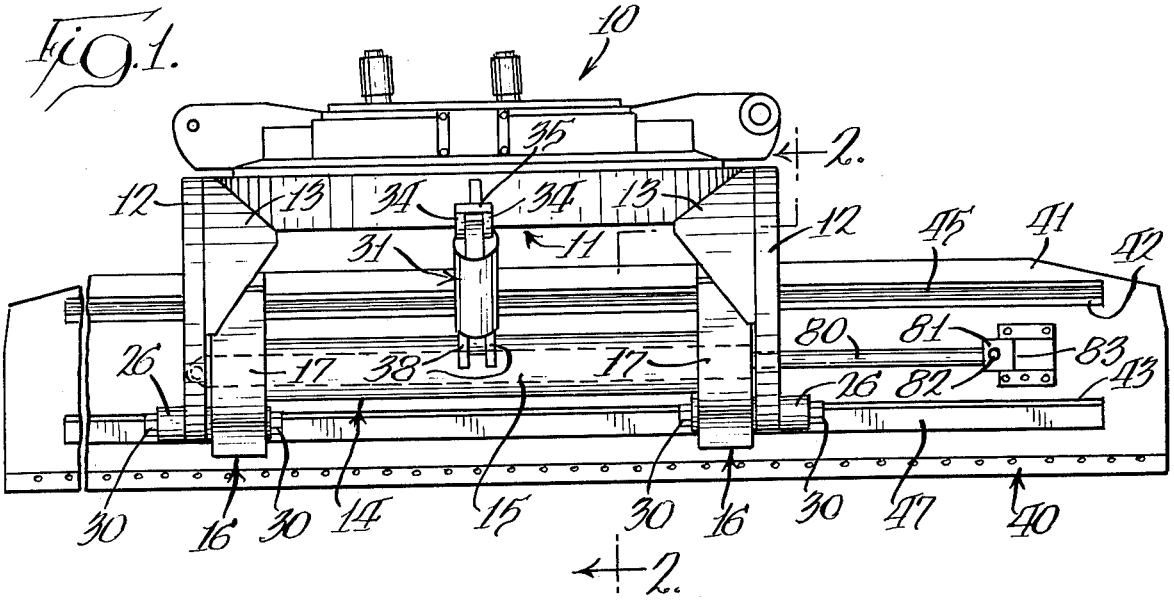
FIG. 1 is a rear elevational view of a motor grader circle, grader blade, and blade support and tilt control embodying the present invention.

Referring to FIG. 1, a circle mounting and drawbar structure, indicated generally at 10, is adapted to be mounted beneath the longitudinal main beam of a motor grader in the usual fashion. A circle structure, indicated generally at 11, is carried beneath the circle mounting 10 and is adapted to be rotated thereon by conventional means such, for example, as an internal gear and drive pinion. A pair of parallel grader blade support arms 12 are welded to the rearward portion of the circle 11 and reinforced by relatively narrow gusset plates 13.

A grader blade housing structure, indicated generally at 14, consists of a hollow, transverse structural member 15 the two ends of which are rigidly secured to upright bearing housings, indicated generally at 16. At best seen in FIG. 2, each of the bearing housings 16 consists of a housing body 17 which is surmounted by an upper bearing cap 18 that cooperates with the upper end portion 19 of the body 17 to provide a forwardly open upper jaw 20. At the lower end portion 21 of the housing body 17 is a forwardly facing, upright planar surface 22 which cooperates with a lower bearing cap 23 and spacer means, indicated generally at 24, to define an upwardly open lower jaw 25.

Figure 2:
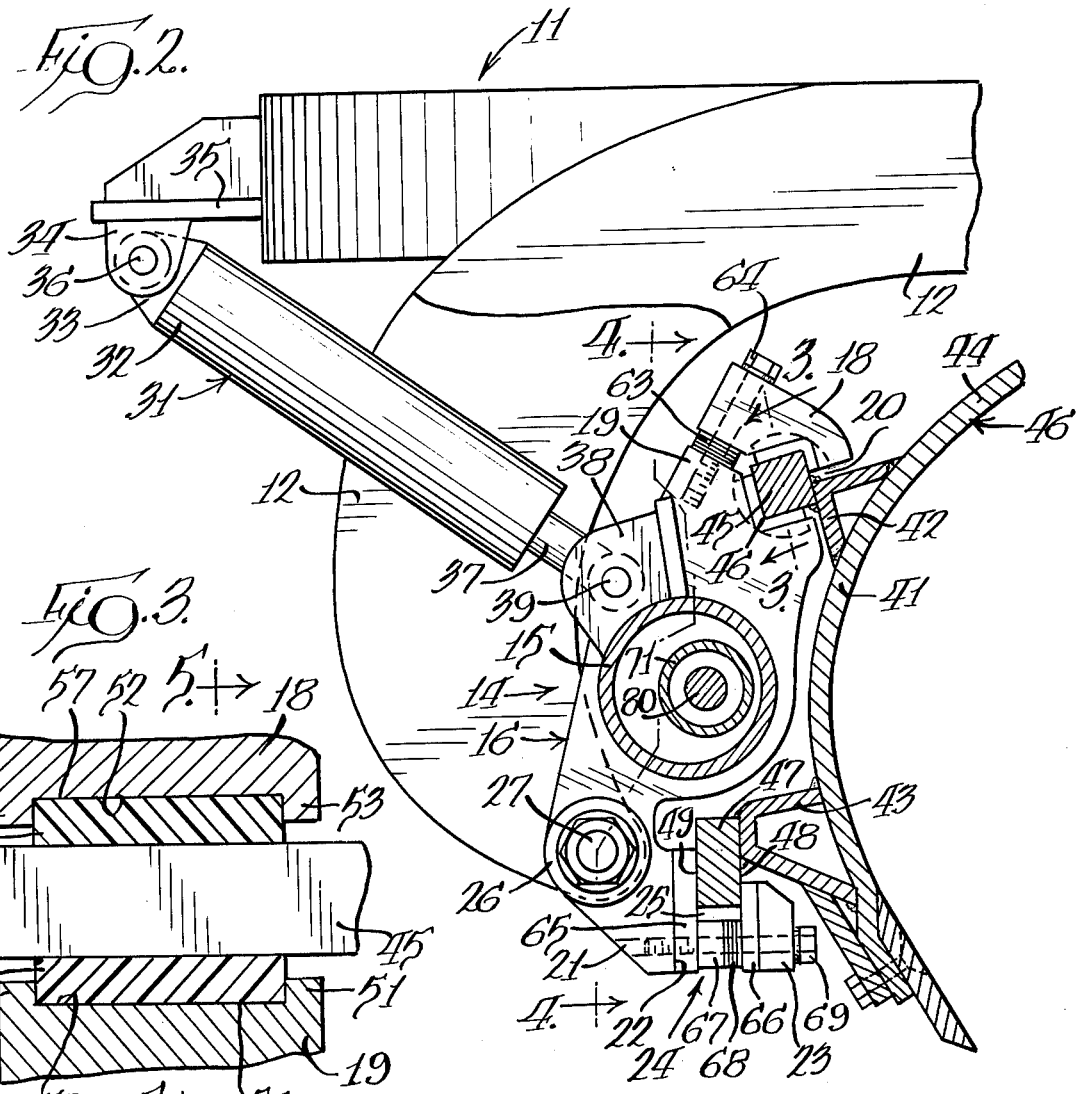
FIG. 2 is a fragmentary sectional view on an enlarged scale taken substantially as indicated along the line 2—2 of FIG. 1.
Figures 4, 5:
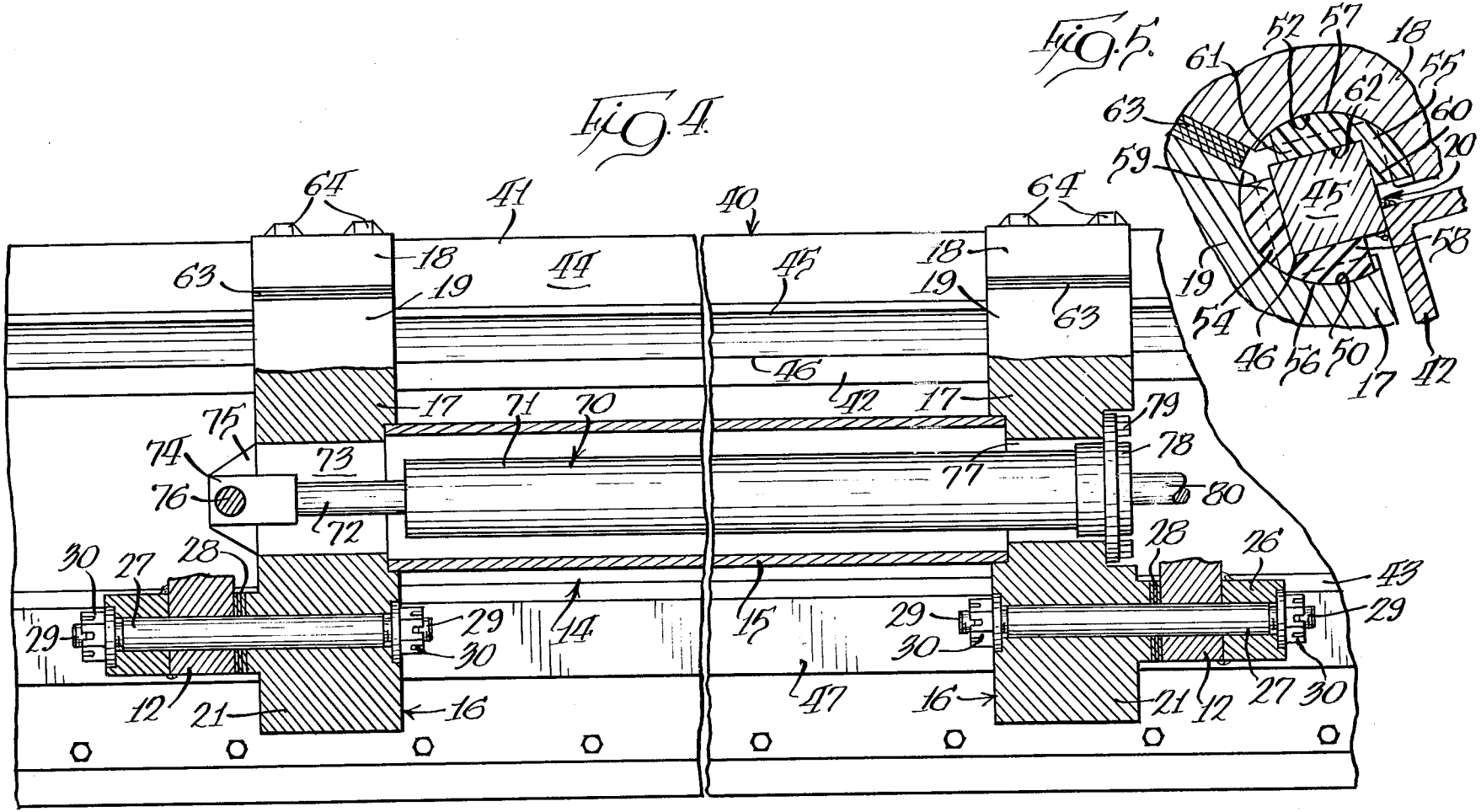
FIG. 4 is a fragmentary sectional view taken substantially as indicated along the line 4—4 of FIG. 2.
FIG. 5 is a fragmentary sectional view on an enlarged scale taken substantially as indicated along the line 5—5 of FIG. 3.

The bearing housing structure 14 is best seen in FIG. 4 to be slightly shorter than the space between the blade mounting arms 12 of the circle structure. Welded to the outer surfaces of the lower end portions of the arms 12 are trunnions 26 which receive pivots 27 that impale the trunnions, the lower end portions of the arms 12, and the lower end portions 21 of the bearing housing bodies 17 so as to pivotally mount the bearing housing structure 14 between the arms 12; and shims 28 provide bearing means between the bearing housing structure 14 and the arms 12 so that the housing structure reinforces the arms against lateral deflection. The pivots 27 have threaded end portions 29 to receive retaining nuts 30. As best seen in FIG. 2, the bearing housing structure 14 is principally forward of the arms 12; and it may be tilted about the pivots 27. Tilting of the bearing housing structure 14 is controlled by a hydraulic cylinder and piston unit, indicated generally at 31, the cylinder 32 of which has a mounting web 33 that extends between depending ears 34 on a bracket 35 which is welded to the rear of the circle structure 11 midway between the blade support arms 12; and a pivot pin 36 impales the ears 34 and the web 33 to pivotally mount the cylinder and piston unit 31 on the circle structure. A piston rod 37 of the cylinder and piston unit 31 is seen in FIGS. 1 and 2 to have its outer end portion positioned between a pair of spaced webs 38 which are welded to the hollow transverse structural member 15; and a pivot pin 39 pivotally connects the piston rod to the webs 38. Thus, extension of the piston rod 37 from the position illustrated in FIG. 2 tilts the bearing housing structure 14 forwardly (clockwise as seen in FIG. 2) about the pivots 27.

A grader blade, indicated generally at 40, includes a mold board 41 which is best seen in FIG. 2 to have an upper bracket 42 and a lower bracket 43 welded to its rear surface 44; and the brackets 42 and 43 extends substantially from end to end of the mold board, which is thus reinforced by the brackets. A square upper rail 45 is welded to the upper bracket 42 with an edge 46 lowermost; and a rectangular lower rail 47 is welded to the lower bracket 43 with its front surface 48 and its rear surface 49 in an upright orientation.

Figure 3:
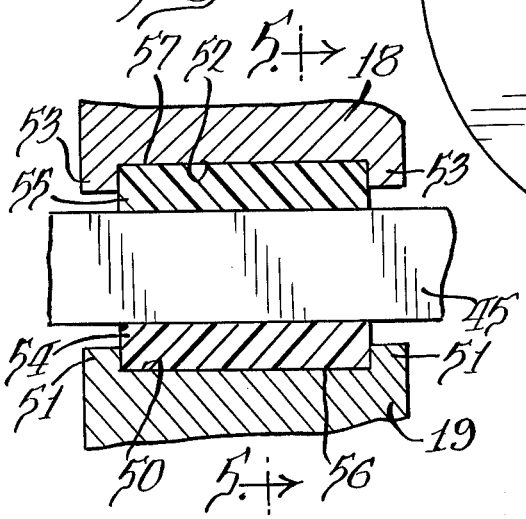
FIG. 3 is a fragmentary sectional view on an enlarged scale taken substantially as indicated along the line 3—3 of FIG. 2.

As best seen in FIGS. 3 and 5, the upper end portion 19 of the bearing housing body 17 has an upwardly open bearing seat 50 which extends most of the way across the bearing housing body 17 and has its sides bounded by shallow rims 51; and the upper bearing cap 18 has a downwardly open bearing seat 52 which is complementary to the seat 50 and has its sides bounded by shallow rims 53. The bearing seats 50 and 52 are both formed as segments of cylinders the axes of which are parallel to the longitudinal axis of the upper blade rail 45. Carried in the lower bearing seat 50 is lower bearing insert 54; and carried in the upper bearing seat 52 is an upper bearing insert 55; and the bearing inserts are provided with arcuate faces 56 and 57, respectively, which are complementary to the cylindrical surfaces of the bearing seats 50 and 52 so that the bearing inserts may rotate in their respective seats 50 and 52. The lower bearing insert 54 has two webs 58 and 59 which are at right angles to one another, and the upper bearing insert 55 has two webs 60 and 61 which are at right angles to one another; and said four webs define a square passage 62 in which the square upper rail 45 is slidably mounted. The upper bearing cap 18 is separated from the upper end of the bearing housing body 17 by shims 63 and secured by bolts 64 which impale said upper bearing caps and shims and are screwed into threaded blind bores in the upper end portion 19 of the bearing housing body 17. The shims 63 permit adjustment of the size of the passage 62 so that the rail 45 may make a close sliding fit in the passages 62; and the capacity of the bearing inserts 54 and 55 to rotate in their respective seats permits the surfaces of the webs 58–61 to be in full surface contact with the four faces of the square upper rail 45. In addition, as the bearing surfaces of the bearing insert web 58–61 wear, the wear can be compensated for by removing a shim 63 as may be needed to maintain a close sliding fit of the rail 45 in the passages 62.

The upwardly open lower jaw 25 is provided with a rear bearing plate 65 which is sandwiched between the upright face 22 of the bearing housing body 17 and the spacer means 24; and there is also a forward bearing plate 66 which is sandwiched between the lower bearing cap 23 and the spacer means 24. The spacer means consists of a spacer block 67 and shims 68; and the entire assembly of lower bearing cap 23, spacer means 24, rear bearing plate 65 and front bearing plate 66 is assembled by means of a plurality of bolts 69 which impale all of said elements and screw into threaded blind bores in the lower end portion 21 of the bearing housing body 17. As is clearly seen in FIG. 2, the lower rail 47 has its forward surface 48 and its rearward surface 49 guided between the facing surfaces of the bearing blocks 65 and 66, but is otherwise entirely out of contact with any portion of the lower jaw 25. This makes it unnecessary that the upper rail 45 and the lower rail 47 be precisely parallel; and the grader blade 40 is entirely supported in the upper jaws 20 and is only retained against by fore-and-aft looseness by the engagement of the lower rail 47 in the upwardly open lower jaw 25. The shims 68 permit small adjustments of the space between the bearing blocks 65 and 66 so that a snug sliding fit may be maintained between the bearing blocks and the lower rail 47 as the bearing blocks wear.

The bearing inserts 54 and 55 and the bearing plates 65 and 66 are preferably fabricated from UHMW Polymer (ultra high molecular weight high density polyethylene), which is available from Hercules Incorporated and requires no lubrication. It is also a very hard and wear-resistant material.

As seen in FIGS. 1, 2 and 4, the grader blade 40 is laterally adjustable in the bearing housing structure 14 by means of a hydraulic ram, indicated generally at 70, which is mounted in the hollow structural member 15. The ram 70 includes a cylinder 71 at the head end of which is a mounting bar 72 which extends through a bore 73 in the lefthand bearing housing body 17 as seen in FIG. 4. At the outer end of the mounting bar 72 is a pivot block 74 which extends between a pair of spaced webs 75 that project laterally outwardly from the bearing housing body 17, and a pin 76 supports the bearing block between the webs. The rod ends of the cylinder 71 extends through an opening 77 in the righthand bearing housing body 17 as seen in FIG. 4, and a mounting collar 78 is detachably secured to said body 17 by bolts 79 in order to support the rod end of the cylinder. A piston rod 80 is seen in FIG. 1 to have its outer end provided with a pivot block 81 so that it may be connected by a pivot 82 with a connecting bracket 83 on the back of the mold board 41.

The hydraulic ram 70 may be removed from the hollow structural member 15 by disconnecting the pivot 82 when the blade is at its extreme righthand position as seen in FIG. 1, retracting the piston rod 80, detaching the pivot 76 at the head end of the cylinder 71, and removing the bolts 79 which secure the mounting collar 78. The ram 70 may then be withdrawn through the opening 77 in the righthand bearing housing body 17.

The foregoing detailed description is given for clearness of understanding only and no unnecessary limitations should be understood therefrom as modifications will be obvious to those skilled in the art.

The embodiments of the invention in which an exclusive property or privilege is claimed are defined as follows:

1. In a motor grader which has a circle with a pair of integral, depending, parallel blade support arms at its rearward portion, an improved support means for mounting a grader blade assembly on said arms for endwise movement, said improved support means comprising, in combination:

a bearing housing structure comprising a pair of generally upright bearing housings and a transverse structural member which has one of said bearing housings integrally secured thereto at each of its ends, said entire bearing housing structure being slightly shorter than the space between the support arms and being devoid of any portions positioned laterally outwardly of said arms, and said bearing housings having open upper jaws and open lower jaws extending entirely across them, said bearing housing structure further being devoid of any portions integrally attached thereto which extend laterally outwardly of and also around said arms;

aligned transverse pivot means in the lower ends of said support arms which engage the bearing housings below said structural member to support said housing structure between said support arms and predominantly forward of the arms;

facing bearing means surrounding said pivot means between said arms and said bearing housings so the bearing housing structure reinforces the arms against lateral deflection;

and substantially parallel upper and lower rails on the rear of the blade assembly which extend through said open jaws and are slidable therein, said jaws and rails having slidably interengaging surfaces to retain the rails in the jaws.

2. The combination of claim 1 in which the upper jaws are forwardly open and include complementary lower and upper bearing seats each of which is a segment of a cylinder that has its axis generally parallel to the length of the upper rail, lower and upper bearing inserts have faces complementary to said bearing seats and have bearing surfaces that define rectangular passages, the upper rail is rectangular and slides in said passages, and said bearing inserts are free to rotate in their seats to assure full contact between their bearing surfaces and the surfaces of the rail, and means are provided to retain the bearing inserts in the seats.

3. The combination of claim 2 in which the means to retain the bearing inserts in the seats comprise integral walls flanking said seats.

4. The combination of claim 2 in which each of the bearing inserts has two webs at right angles to one another so as to provide two bearing surfaces of the rectangular passage.

5. The combination of claim 2 in which the upper rail and the rectangular passages are square and have an edge lowermost.

6. The combination of claim 1 in which each upper jaw is forwardly open and is defined by complementary parts of the upper end of a bearing housing body and by an upper bearing cap which detachably surmounts said housing body, there are complementary lower and upper bearing seats in each said jaw, and lower and upper bearing inserts in said bearing seats provide the upper jaw surfaces which slidably engage the upper rail, and means are provided to retain the bearing inserts in the seats.

7. The combination of claim 6 in which the lower and upper bearing inserts in each of said upper jaws define a rectangular passage, and in which the upper rail is rectangular and slides in said passages.

8. The combination of claim 7 in which each of the bearing inserts has two webs at right angles to one another so as to provide two bearing surfaces of the rectangular passage.

9. The combination of claim 7 in which each of the bearing seats in the housings and in the upper bearing caps is a segment of a cylinder that has its axis generally parallel to the length of the upper rail, and each of the bearing inserts has a face complementary to a bearing seat, whereby said inserts may rotate in their seats to assure full surface contact between the surfaces of the bearing inserts and the surfaces of the rectangular upper rail.

10. The combination of claim 6 which includes shims beneath the detachable upper bearing caps to adjust the space between the lower and upper bearing inserts.

11. The combination of claim 1 in which the upper jaws are forwardly open and the upper rail supports the grader blade assembly in said upper jaws, and the lower jaws are upwardly open and have parallel front and rear internal surfaces between which the lower rail slides, said lower rail being otherwise out of contact with the lower jaws at all times.

12. The combination of claim 11 in which the lower end portions of the upright housings have forwardly facing surfaces, forward bearing caps detachably secured to said lower end portions have rearwardly facing surfaces, spacers are mounted between said forwardly facing surfaces and said rearwardly facing surfaces, and bearing plates sandwiched between said surfaces and said spacers define the internal surfaces between which the lower rail slides.

13. The combination of claim 12 in which each upper jaw is forwardly open and is defined by complementary parts of the upper end of a bearing housing body and by an upper bearing cap which detachably surmounts said housing body, there are complementary lower and upper bearing seats in each said jaw, and lower and upper bearing inserts in said bearing seats provide the upper jaw surfaces which slidably engage the upper rail, and means are provided to retain the bearing inserts in the seats.

14. The combination of claim 13 in which the lower and upper bearing inserts in each of said upper jaws define a rectangular passage, and in which the upper rail is rectangular and slides in said passages.

15. The combination of claim 1 which includes a single hydraulic ram pivotally mounted on the rear of the circle structure midway between the blade support arms, said ram having a piston rod pivotally connected to the transverse structural member to control the angular disposition of the bearing housing structure on said support arms.

16. In a motor grader, an improved circle and blade support structure comprising, in combination:

a circle which has parallel, depending blade support arms at its rearward portion;

relatively narrow gusset plates secured to the upper portions of the blade support arms and to the circle between said arms;

a bearing housing structure comprising a pair of generally upright bearing housings and a transverse structural member which has one of said bearing housings integrally secured thereto at each of its two ends, said entire bearing housing structure being slightly shorter than the space between the support arms and being devoid of any portions positioned laterally outwardly of said arms, said bearing housings having open upper jaws and open lower jaws extending entirely across them to slidably receive upper and lower rails of a grader blade assembly said bearing housing structure further being devoid of any portions integrally attached thereto which extend laterally outwardly of and also around said arms;

aligned transverse pivot means in the lower ends of said support arms which engage the bearing housings below said structural member to support said housing structure between said support arms and predominantly forward of the arms;

and facing bearing means surrounding said pivot means between said arms and said bearing housings so the bearing housing structure reinforces the arms against lateral deflection.

17. The combination of claim 16 which includes a single hydraulic ram pivotally mounted on the rear of the circle structure midway between the blade support arms, said ram having a piston rod pivotally connected to the transverse structural member to control the angular disposition of the bearing housing structure on said support arms.

18. In a motor grader which has a circle with a pair of integral, depending, parallel blade support arms at its rearward portion, an improved support means for mounting a grader blade assembly on said arms for endwise movement, said improved support means comprising, in combination:

a pair of generally upright bearing housings each of which has a forwardly open upper jaw extending entirely across it with lower and upper bearing surfaces, and an upwardly open lower jaw extending across it with parallel front and rear internal bearing surfaces;

aligned transverse pivot means in the lower ends of said support arms which impale complementary holes in said bearing housings behind said lower jaws to pivotally support said bearing housings predominantly forward of the arms;

and substantially parallel upper and lower rails on the rear of the blade assembly which extend through said open jaws and are slidable therein, said upper rails having surfaces slidably engaging the bearing surfaces in the upper jaws to support the blade assembly on said bearing housings, and said lower rails making a close sliding fit between said front and rear internal bearing surfaces and being otherwise free of contact with the bearing housings at all times, whereby the blade assembly is supported solely by the upper jaws and is only restrained against fore-and-aft movement by the lower jaws.

19. The combination of claim 18 in which the upper jaws include complementary lower and upper bearing seats each of which is a segment of a cylinder that has its axis generally parallel to the length of the upper rail, lower and upper bearing inserts have faces complementary to said bearing seats and have bearing surfaces that define rectangular passages, the upper rail is rectangular and slides in said passages, and said bearing inserts are free to rotate in their seats to assure full contact between their bearing surfaces and the surfaces of the rail, and means are provided to retain the bearing inserts in the seats.

20. The combination of claim 19 in which the upper rail and the rectangular passages are square and have an edge lowermost.

21. The combination of claim 18 in which each upper jaw is defined by complementary parts of the upper end of a bearing housing body and by an upper bearing cap which detachably surmounts said housing body, there are complementary lower and upper bearing seats in each said jaw, and lower and upper bearing inserts in said bearing seats provide the upper jaw surfaces which slidably engage the upper rail, and means are provided to retain the bearing inserts in the seats.

22. The combination of claim 21 in which the lower and upper bearing inserts in each of said upper jaws define a rectangular passage, and in which the upper rail is rectangular and slides in said passages.

23. The combination of claim 22 in which each of the bearing seats in the housings and in the upper bearing caps is a segment of a cylinder that has its axis generally parallel to the length of the upper rail, and each of the bearing inserts has a face complementary to a bearing seat, whereby said inserts may rotate in their seats to assure full surface contact between the surfaces of the bearing inserts and the surfaces of the rectangular upper rail.

24. The combination of claim 18 in which each lower jaw comprises an upright forwardly facing surface at the lower portion of the housing, a lower bearing cap which has an upright rearwardly facing surface, spacer means between the lower portions of said forwardly and rearwardly facing surfaces, bearing inserts flanking the spacer means and providing said bearing surfaces, and means detachably mounting said spacer means, said bearing inserts and said lower bearing cap on the housing.

25. The combination of claim 18 which includes a transverse structural member rigidly joining said bearing housings forward of the support arms, and a single hydraulic ram pivotally mounted on the rear of the circle structure midway between the blade support arms, said ram having a piston rod pivotally connected to the transverse structural member to control the angular disposition of the bearing housing structure on said support arms.

* * * * *